US005211096A

United States Patent [19]

Steidinger

[11] Patent Number: 5,211,096

[45] Date of Patent: May 18, 1993

[54] APPARATUS FOR CUTTING

[75] Inventor: Donald J. Steidinger, Barrington, Ill.

[73] Assignee: Tamarack Products, Inc., Wauconda, Ill.

[21] Appl. No.: 828,187

[22] Filed: Jan. 30, 1992

Related U.S. Application Data

[63] Continuation-in-part of Ser. No. 627,214, Dec. 13, 1990, Pat. No. 5,086,683.

[51] Int. Cl.[5] ..... B26D 1/62

[52] U.S. Cl. ..... 83/674; 83/346; 83/700

[58] Field of Search ..... 83/343, 346, 348, 673, 83/674, 675, 698, 700

[56] References Cited

U.S. PATENT DOCUMENTS

| | | | |
|---|---|---|---|
| 3,251,256 | 5/1966 | McGrath | 83/674 |
| 3,340,757 | 9/1967 | Rudzinat | 83/674 |
| 3,477,328 | 11/1969 | Schonmeier et al. | 83/700 |
| 3,865,164 | 2/1975 | Sybertz | 83/698 |
| 3,935,774 | 2/1976 | Craddy | 83/699 |
| 4,068,694 | 1/1978 | Schmidt et al. | 83/698 |
| 4,475,425 | 10/1984 | Punater et al. | 83/700 |
| 4,785,697 | 11/1988 | Gherardi | 83/699 |
| 4,848,202 | 7/1989 | Crampton | 83/674 |
| 4,920,843 | 5/1990 | Strömberg et al. | 83/699 |

*Primary Examiner*—Hien H. Phan

*Attorney, Agent, or Firm*—Tilton, Fallon, Lungmus & Chestnut

[57] ABSTRACT

Apparatus for cutting which involves the adjustment of height of the cutting blades in a rotating cylinder through the use of cooperating tapered surfaces on two components of a blade supporting bar.

9 Claims, 3 Drawing Sheets

Fig. 1
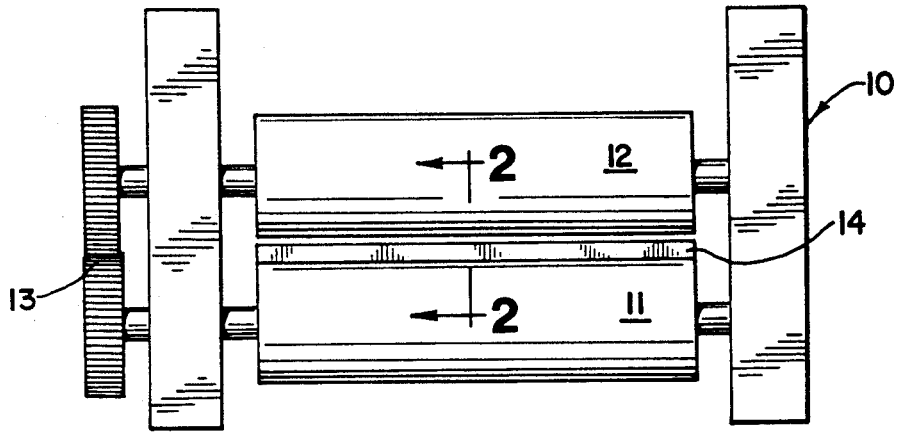
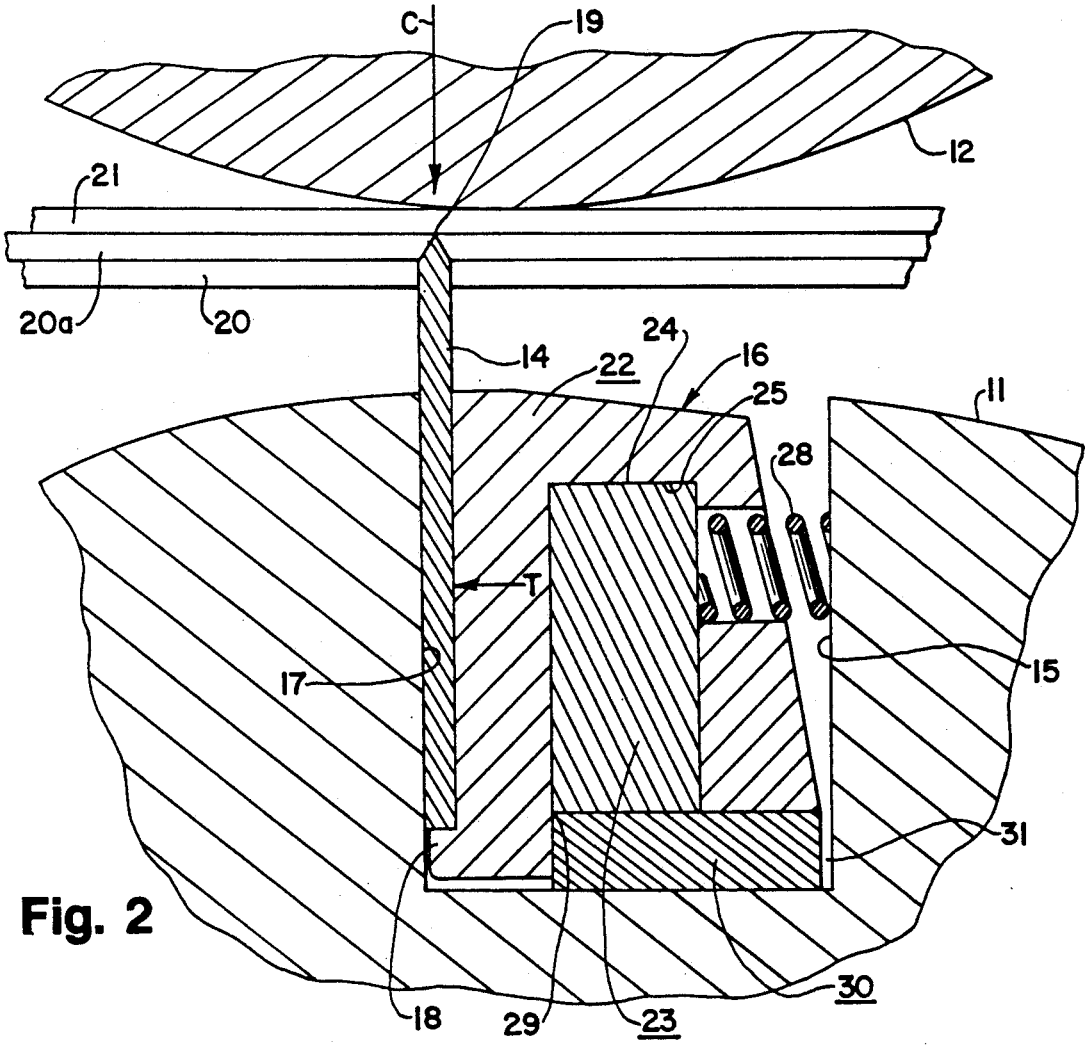
Fig. 2

APPARATUS FOR CUTTING

This application is a continuation-in-part of my copending application Ser. No. 627,214 filed Dec. 13, 1990, now U.S. Pat. No. 5,086,683.

BACKGROUND OF INVENTION

This invention relates to apparatus for cutting and more particularly to improvements for mounting and fine adjusting of cutting blades in a rotating cylinder for cutting and perforating continuous webs of paper, plastic, fabric, etc. More specifically, the invention provides for accurate adjustment of the blade height that is easily and quickly made by the machine operator.

Currently, the bulk of the fast change cutters and/or perforators are either of the type seen in U.S. Pat. No(s). 4,848,202 or 4,920,843. Each of these has significant drawbacks in terms of the ease and quickness of adjustment for blade height.

SUMMARY OF INVENTION

According to the invention, a pair of axially tapered members are employed to incrementally change the height of the blade sharpened end with the tapered members having confronting, contacting surfaces generally chordally relative to the blade carrying cylinder.

Other objects and advantages of the invention may be seen in the details of the ensuing specification.

BRIEF DESCRIPTION OF DRAWING

The invention is explained in conjunction with the accompanying drawing, in which FIG. 1 is an end elevational view of apparatus for practicing the invention;

FIG. 2 is an enlarged fragmentary sectional view such as would be seen along the sight line 2—2 applied to FIG. 1;

DETAILED DESCRIPTION

Figure 3:
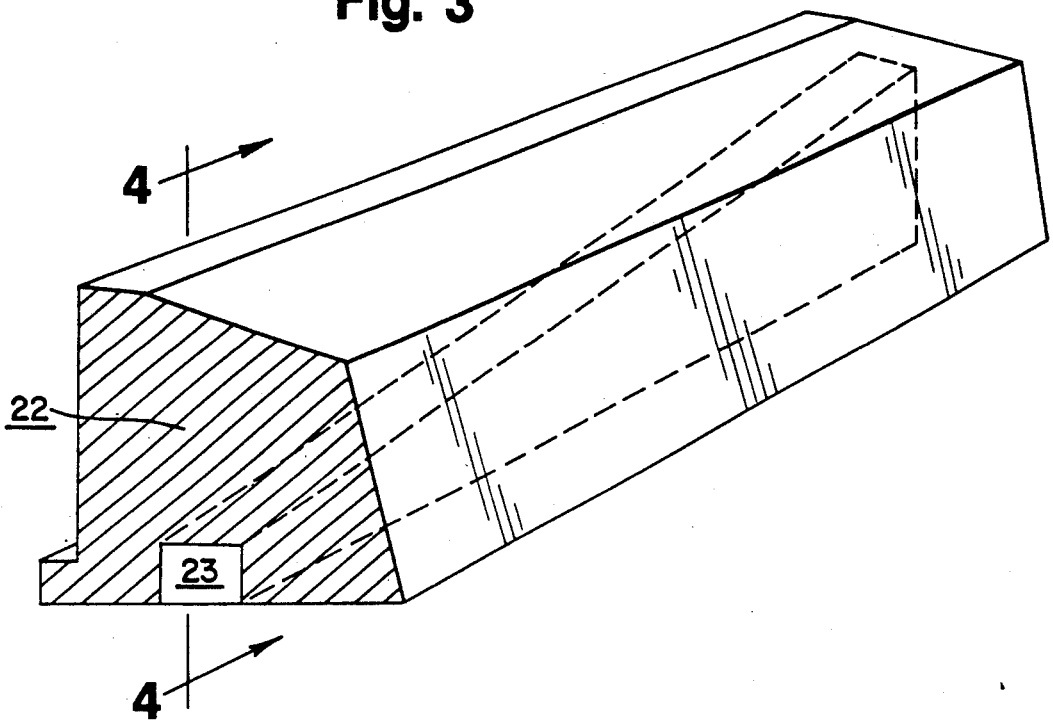
FIG. 3 is a perspective view of the two bars employed for height adjustment.

In FIG. 1 the numeral 10 designates generally the frame of the apparatus which rotatably supports a blade cylinder 11 and an impression cylinder 12. These are rotated by a gear train 13. The numeral 14 designates the blade carried by the blade cylinder 11. This showing is the same as in my above-mentioned copending application Ser. No. 627,214, now U.S. Pat. No. 5,086,683 and reference may be had to that disclosure for details of construction and operation not set forth specifically herein.

One clamping arrangement for the blade 14 in the cylinder 11 is seen in FIG. 2. A slot 15 is cut across the axial length of a rotating blade-holding or blade-carrying cylinder 11.

FIG. 2 shows an advantageous embodiment of the invention. Blade 14 is mounted between the bar 16 and one side wall 17 at ledge 18. The blade edge 19 is supported at some chosen distance above the blade cylinder 11 surface so that it just contacts impression cylinder 12 if cutting is to be through all plies or at some precise chosen distance short of impression cylinder 12 if the cutting is to be through only some of the plies. For instance, it may be desired to perforate or to cut completely through two plies 20 and 20a but not to perforate or to cut a third ply 21 immediately in contact with impression cylinder 12. Because paper, plastic, fabric plies, or the like are commonly 0.001 to 0.005 inch in thickness, it can be seen that the height adjustment of blade 14 must be precise.

The bar 16 of this invention is made of two parts 22 and 23 which have tapered surfaces 24 and 25 in engagement. The part 22 which supports the blade 14 ordinarily is restrained from movement across the length (i.e., the axial dimension) of the slot 15 by means well known in the art such as bearers, viz., discs affixed to the ends of roll 11. The part 23 has means to move along the length of the slot 15 thus raising and lowering the height of the blade 14 by means of the tapered surfaces 24 and 25.

Figure 5:
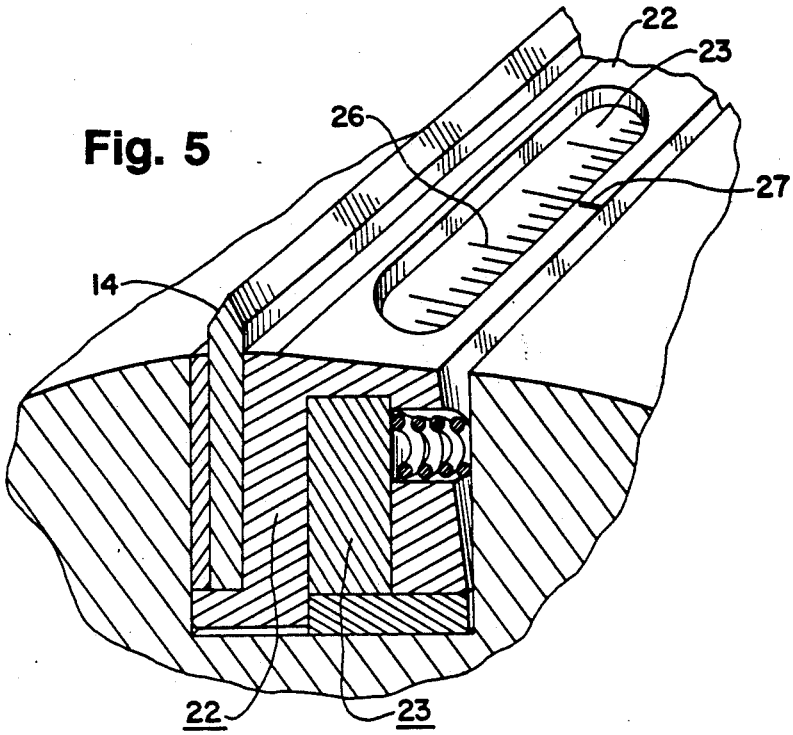
FIG. 5 is a fragmentary top perspective view showing the assembly of elements employed for height adjustment and also featuring a register.

The amount of ramp or incline, i.e., the ratio between height and axial length is advantageously of the order of 10:1 to 100:1 so that easily read graduations on the parts 22 and 23 indicate movements of 0.001 inch in blade height adjustment. This is seen in FIG. 5 where a scale or register 26 is provided on the lower part 23 and an indicator mark 27 is provided on the part 22.

The bar part 22 is pressed against the blade 14 by springs 28 clamping the blade between slot wall 17 and part 22. This clamping force is relatively small and is used to hold the blade when cutting is not actually taking place. During actual cutting, the cutting force C on the blade causes a torque T on part 22 clamping blade 14 much more securely.

More particularly, the cutting force C results in a radially inward force on the ledge 18 tending to pivot part 22 around the point 29 (see FIG. 2). This causes the base 30 to move to the right in FIG. 2 to take up the clearance 31—thus resulting in torque T. The clearance 31 is required in order to pivot the part 22 when changing blades 14.

The invention finds application both with a resilient base 30 or a rigid base 30. When die cutting (as illustrated in FIG. 2) the base 30 is advantageously rigid so as to maintain the tip 19 of the blade 14 in predetermined position. This also applies to cutting where the tip of the blade 14 comes just into "kissing" contact with the surface of the impression or anvil roll 12. On the other hand, as was described in my copending application Ser. No. 627,214 where there is interference between the blade and the impression cylinder, the interference is taken up by virtue of having a resilient base 30.

Figure 6:
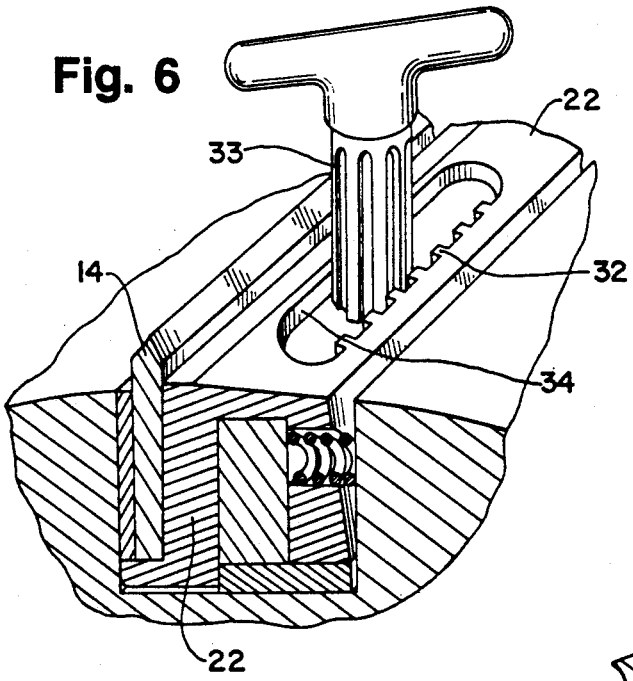
FIG. 6 is a view similar to FIG. 5 and featuring a rack and pinion tool for advantageously adjusting the height.
Figure 7:
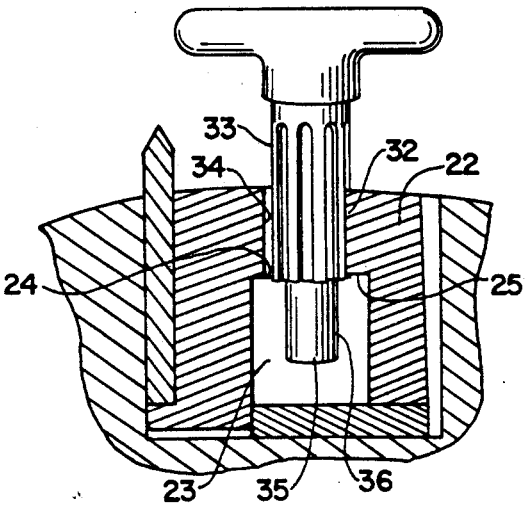
FIG. 7 is a fragmentary sectional view taken along the sight line 7—7 of FIG. 6.

FIG. 6 shows an arrangement using a rack and pinion that is especially advantageous for the machine operator. A form of a T-handled key. The key has pinion gear portion 33 and a cylindrical end portion 35 shown in FIG. 7. In use the key is inserted through hole 34 in part 22 with the cylindrical end portion 35 in hole 36 in part 23 and pinion gear portion 33 engaged in rack 32. By rotation of the pinion 33 in one direction or the other part 23 is caused to move in relation to part 22 thus causing the blade height to be raised or lowered accordingly.

OPERATION

Generally, the invention involves a means for mounting a blade in position in a slot of a rotating cylinder so that the blade can be very accurately adjusted for height. This is advantageous in normal cutting and perforating operations where the cutting is through all plies and which thereby enhances blade life and smooth, quiet running. This adjustment becomes especially advantageous when the cutting is to be through some but not all of multiple plies passing through the cutting station or roll nip simultaneously.

Figure 4:
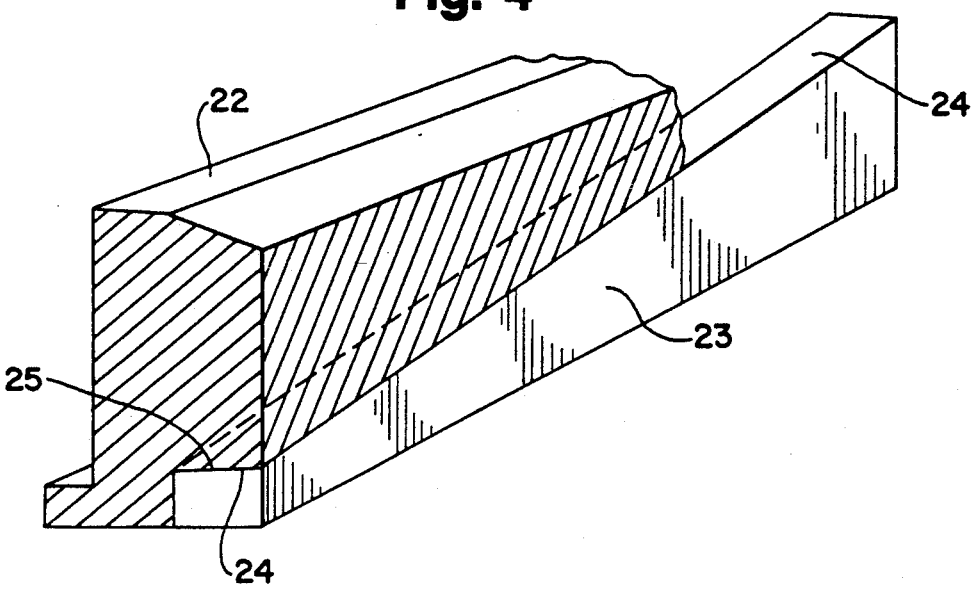
FIG. 4 is a fragmentary longitudinal sectional view of the assembled bars of FIG. 3 such as would be seen along the sight line 4—4 applied to FIG. 3.

This invention involves cooperating ramps or inclined planes on two member components of the blade supporting bar 16. As seen in FIG. 2, the bar generally designated 16 is made up of a generally U-shaped part 22 and a generally rectangular part 23. The confronting surfaces 24, 25 are sloped as can be readily appreciated from a consideration of the right hand portion of FIG. 4 where the inclined surface 24 of the part 23 is clearly seen.

The part 23 can be moved in relation to the part 22 by many means including simple prying using a suitable tool, adjusting screw eccentrics or rack and pinion such as is illustrated in FIG. 6.

The means for indicating the amount of adjustment of blade 14 upwards or downwards can be very simple and accurate because a large movement of part 23 in relation to part 22 results in a small adjustment of blade height.

For example, a reference graduation 27 is positioned on a part 22 (see FIG. 5). Cooperating graduation marks 26 are provided on part 23 to indicate a convenient change in blade height, advantageously 0.001 inch when part 23 is moved the distance of one graduation. The graduations are spaced much further apart than the adjustment made due to the ratio of change in blade height to movement of part 22 resulting from the angle of incline used on surfaces 24 and 25. It may be advantageous in certain instances to interchange the graduations on the parts 22 and 23 still providing the same result and indication.

It should be appreciated that the inventive adjustment means is particularly advantageous when employed in conjunction with the blade changing procedure and apparatus of my copending application Ser. No. 627,214. However, there are other applications to which the instant invention can be put to advantageous use.

While in the foregoing specification a detailed description of the invention has been set down for the purpose of illustration, many variations in the details hereingiven may be made by those skilled in the art without departing from the spirit and scope of the invention.

I claim:

1. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls, blade-supporting bar means mounted in said slot having a bottom wall adjacent said slot bottom wall, said bar means being equipped with generally circumferentially-extending integral ledge means adjacent said bar bottom wall, and a blade mounted on said ledge means and interposed between said bar means and one sidewall of said slot, said bar means including axially extending generally chordally disposed ramp means for adjusting the blade height relative to said impression roll, said ramp means including cooperating surfaces which extend axially and are movable axially relative to one another to support said bar means for radial movement without substantially affecting clamping of said blade by said bar means.

2. The apparatus of claim 1 in which said bar means includes two component parts having engaged tapered surfaces providing said ramp means.

3. The apparatus of claim 2 in which one of said component parts is integrally equipped with said ledge means.

4. The apparatus of claim 2 in which graduation means are provided on said component parts to indicate the amount of height adjustment.

5. The apparatus of claim 2 in which the ratio of length to height between said component parts is of the order of about 10:1 to about 100:1.

6. The apparatus of claim 1 in which spring means are operatively associated with said blade roll bearing against said bar means for exerting a generally circumferential force against said bar means to clamp said blade.

7. The apparatus of claim 6 in which a rigid base is provided in said slot to maintain the tip of said blade at a predetermined height.

8. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls.

blade-supporting bar means mounted in said slot having a bottom wall adjacent said slot bottom wall, said bar means being equipped with generally circumferentially-extending integral ledge means adjacent said bar bottom wall, and a blade mounted on said ledge means and interposed between said bar means and one sidewall of said slot, said bar means including axially extending generally chordally disposed ramp means for adjusting the blade height relative to said impression roll, said bar means including two component parts having engaged tapered surfaces providing said ramp means, said component parts being equipped with rack and pinion means to incrementally adjust blade height.

9. Apparatus for cutting web material comprising a frame, a blade roll rotatably mounted on said frame, an impression roll rotatably mounted on said frame adjacent said blade roll, said blade roll being equipped with an axially-extending slot having a radially inward generally circumferentially-extending bottom wall and spaced generally radially-extending side walls, blade-supporting bar means mounted in said slot having a bottom wall adjacent said slot bottom wall, said bar means being equipped with generally circumferentially-extending integral ledge means adjacent said bar bottom wall, and a blade mounted on said ledge means and interposed between said bar means and one sidewall of said slot, said bar means including axially extending generally chordally disposed ramp means for adjusting the blade height relative to said impression roll, spring means being operatively associated with said blade roll bearing against said bar means for exerting a generally circumferential force against said bar means to clamp said blade, a resilient base being provided in said slot to permit exertion of a radial force against said bar means.

* * * * *